United States Patent [19]

Hinchcliffe et al.

[11] Patent Number: 4,915,572

[45] Date of Patent: Apr. 10, 1990

[54] CONVEYOR SYSTEM FOR ROD-LIKE ARTICLES

[75] Inventors: Dennis Hinchcliffe, Orpington; Desmond W. Molins, High Wycombe, both of England

[73] Assignee: Molins PLC, Milton Keynes, England

[21] Appl. No.: 49,939

[22] Filed: May 15, 1987

[30] Foreign Application Priority Data

May 15, 1986 [GB] United Kingdom ..... 8611873

[51] Int. Cl.[4] ..... B65G 1/00

[52] U.S. Cl. ..... 414/416; 414/796.1; 414/796; 414/403; 414/331; 414/798.9; 414/790.3; 198/347; 198/428; 198/689.1

[58] Field of Search ..... 414/331, 403, 416, 417, 414/797, 269, 796, 373, 390, 391, 398, 798.9, 796.1, 790.3, 752, 661, 280; 198/428, 468.4, 347, 689.1, 434, 425; 53/148, 150, 149, 247

[56] References Cited

U.S. PATENT DOCUMENTS

| | | | |
|---|---|---|---|
| 2,682,983 | 7/1954 | Ashcroft | 414/796.1 X |
| 3,519,143 | 7/1970 | Kochalski et al. | 198/428 X |
| 3,967,740 | 7/1976 | Molins | 414/417 X |
| 4,039,071 | 8/1977 | Garton et al. | 198/425 |
| 4,181,212 | 1/1980 | Hinchcliffe | 198/425 X |
| 4,201,507 | 5/1980 | Hinchcliffe et al. | 414/331 |
| 4,338,057 | 7/1982 | Molins | 414/403 X |
| 4,413,640 | 11/1983 | Wahle et al. | 198/347 X |
| 4,423,996 | 1/1984 | Applegate et al. | 414/403 X |

FOREIGN PATENT DOCUMENTS

| | | | |
|---|---|---|---|
| 2418562 | 11/1974 | Fed. Rep. of Germany | 198/689.1 |
| 1196821 | 7/1970 | United Kingdom . | |
| 1350330 | 4/1974 | United Kingdom . | |
| 1537051 | 12/1978 | United Kingdom . | |
| 2091198 | 7/1982 | United Kingdom . | |

*Primary Examiner*—Frank E. Werner

*Attorney, Agent, or Firm*—Antonelli, Terry & Wands

[57] ABSTRACT

A cigarette buffer reservoir system includes mobile containers (18) which are loaded and unloaded by transfer of successive batches of cigarettes between the container and a common transfer station (16) connected to a mass flow conveyor system (2–19) linking at least one maker (3) and at least one packer (5). The transfer station (16) has suction assistance (32) bearing on the ends of the cigarettes to allow separation of cigarettes in a container into batches for transfer during unloading. The transfer station (16) preferably also includes a conveyor (26) with retractable spaced partitions (30) for supplying or receiving successive batches, and at least one pusher (32,34) for transferring batches to or from the conveyor in a direction parallel to the cigarettes.

23 Claims, 6 Drawing Sheets

CONVEYOR SYSTEM FOR ROD-LIKE ARTICLES

Figure 1:
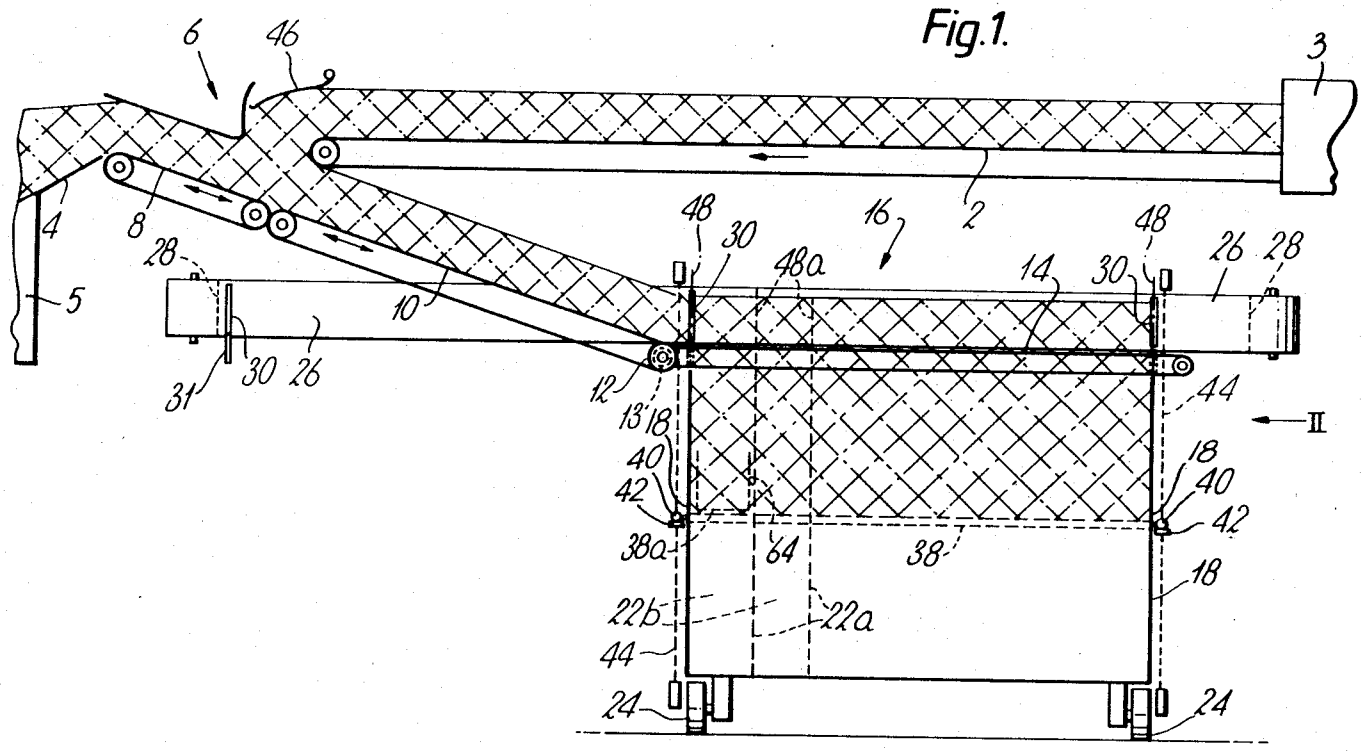

This invention relates to a conveyor system for rod-like articles, particularly articles of the tobacco industry such as cigarettes or cigarette filter rods.

In the cigarette industry it is known to link a machine for producing rod-like articles, e.g. a cigarette making machine or filter rod making machine, to a machine for receiving the articles, e.g. a cigarette packing machine or filter rod distribution unit, by means of a conveyor system in which the articles are conveyed in mutli-layer stack formation. It is also known to provide in such a system a buffer reservoir for articles to compensate for differences between the supply rate of the producing machine and the demand rate of the receiving machine. Examples of such systems where the buffer reservoir includes provision for storing articles in separable containers are disclosed in British patent specifications Nos. 1404141, 2035248 and 2142894.

According to a first aspect of the invention a conveyor system for rod-like articles comprises an article delivery device, an article receiving device, conveyor means linking said devices, and a reversible reservoir for articles connectable to said conveyor means, including means for tranferring articles between the reservoir and the conveyor means, the tranferring means including suction means for effecting separation between articles to allow relative movement of said articles. In a preferred arrangement the suction is applied to the ends of the articles and may co-operate with a membrane or other member adapted to seal around the opposite ends of the articles. The articles to be separated may be in multi-layer stack formation and suction may be applied on one or both sides of a line along which it is required to separate the formation.

In a preferred arrangement a movable suction member may be arranged adjacent a mass flow stream and is effective both to separate a batch from said stream and to convey the batch to a subsidiary conveyor linked to said conveyor means. The subsidiary conveyor may have associated partitions which define spaces for receiving successive batches transferred by said suction member. Said suction member may move the articles in a direction transverse to their lengths (e.g. the member may comprise a suction band conveyor) or it may move the articles in a direction substantially parallel to their lengths (e.g. it may comprise a suction plunger).

The transferring means may further include means for moving successive batches of articles into the vicinity of said suction means. Said moving means may comprise a lifting member movable in a container which is capable of holding the equivalent of several batches. Successive containers may be supplied to the transferring means in a mobile reservoir, e.g. a trolley containing several containers.

In a preferred arrangement the reservoir comprises a reversible buffer store for the articles, such that the transferring means is reversible. In a preferred arrangement, in which articles are moved in a generally upward direction when being transferred from the reservoir to the conveyor means and correspondingly in a downward direction when being transferred from the conveyor means to the reservoir, said suction means is preferably used for separation when articles are being transferred from the reservoir to the conveyor means.

According to another aspect of the invention a conveyor system for rod-like articles comprises an article delivery device, an article receiving device, conveyor means linking said devices, and a reversible reservoir for articles connectable to said conveyor means, said reservoir including at least one container in which articles are stored in multi-layer stack formation, and means for separating said articles into batches for transfer to said conveyor means, said separating means including means acting on the ends of at least the lowermost articles in a batch and means for effecting separation in a direction transverse to said articles. Preferably said separating means includes means for moving a batch in a direction generally parallel to said articles to transfer the batch onto a subsidiary conveyor of said conveyor means. Preferably said subsidiary conveyor is associated with partitions spaced by a distance corresponding to the width of a batch.

The separating means may include means operable on both ends of the lowermost articles in a batch, e.g. opposed pressure members, or one or more rows of needles and a pressure member, or a suction member and sealing membrane. The separating means may include means, e.g. a further suction member, operable on articles in the container adjacent said lowermost articles to further ensure a clean separation of said articles.

The separating means may include means for displacing the batch in a direction away from articles in the container simultaneously with or prior to movement in any other direction.

Where the subsidiary conveyor carries or is associated with spaced partitions means is preferably provided for withdrawing said partitions from the path of successive batches transferred to the subsidiary conveyor whereby successive batches coalesce to form a substantially continuous stream. Conversely, on operation of the system to transfer articles to the container the partitions associated with the subsidiary conveyor are preferably progressively inserted into a continuous stream supplied towards said conveyor to form batches for transfer to a container.

Where said separating means includes suction acting on the ends of articles the articles may be inclined so that gravity aids the effect of said suction to retain said articles.

According to another aspect of the invention a method of separating first articles and second articles in a multi-layer stack of rod-like articles comprises applying suction in a direction parallel to said articles to at least some of said first articles adjacent said second articles so that said first articles are subjected to a greater influence of said suction than said second articles. The second articles may also be subjected to suction (which is in some sense controllable separately from the suction applied to the first articles).

Separation may be achieved by subsequent relative movement of first and second articles, e.g. by movement of one or more suction members retaining first and/or second articles, either in directions parallel to or transverse to the lengths of the articles. Separation may be supplemented by physical separating means, e.g. a divider plate inserted between first and second articles or a plunger acting differentially on said first and second articles, or a transversely-moving member acting on exposed ends of first or second articles. It will be appreciated that such physical separating means is assisted in its operation by the action of suction, e.g. in retaining and/or moving first articles to allow the physical separating means to operate.

According to a further aspect of the invention a conveyor system for rod-like articles includes container loading apparatus arranged to transfer batches of articles into a container such that successive batches are stored in the container in axially staggered formation whereby subsequent removal of batches from the container is facilitated by engagement with the axially overlapping portions of said batches. Such loading apparatus may be incorporated in systems according to any other aspect of the invention.

In a preferred arrangement of the present invention the system is reversible but separation of articles is effected primarily for transfer from the reservoir to the conveyor means. This results from the general requirement to transfer from a container holding a formation having a height considerably greater than that normally conveyed in a stream on an endless band conveyor. In this case, and particularly where a partition conveyor is used in association with a subsidiary conveyor leading to said conveyor means, the operation of the transfer means is intermittent. However, continuous transfer of batches is within the scope of the present invention (and for this purpose the reference to a batch, although less appropriate, should be construed accordingly). Thus, where the reservoir includes a container, and a movable platform to remove progressively articles from the container, an upper suction conveyor acting on the ends of the uppermost articles in the container, or more usually in a subsidiary reservoir above the container, may be driven substantially continuously (while it is required to transfer articles in this direction) so that articles are continuously engaged and conveyed by the conveyor and urged towards the subsidiary conveyor. Further suction means (e.g. a conveyor) may be provided to act on the upper surface of the articles being conveyed away from the reservoir. Thus where articles are being lifted from a container into the region of a suction conveyor acting on their ends the upper limit of movement for the articles may be defined by a top suction conveyor conveying the articles in the same direction as the suction conveyor acting on their ends. In a preferred arrangement both conveyors (and the intended direction of main flow of the articles towards the subsidiary conveyor) are inclined upwardly at about 30° to the horizontal.

According to a further aspect of the invention a conveyor system for rod-like articles, preferably including a reversible reservoir for articles, comprises first conveyor means for conveying rod-like articles in multi-layer stack formation having a first height, second conveyor means for conveying rod-like articles in multi-layer stack formation having a second height, said second height being greater than said first height, and means for transferring articles between said first and second conveyor means, said transferring means including first means for separating articles into batches on said first conveyor means, and second means for separating articles into batches on said second conveyor means, and means for moving said first and second means on intersecting paths to effect transfer of batches between said first and second conveyor means. Preferably said first conveyor means comprises an endless band conveyor and said second conveyor means comprises a movable container, e.g. a tray. Preferably said second height is an integral multiple of said first height. Preferably said second separating means includes suction means.

Figure 2:
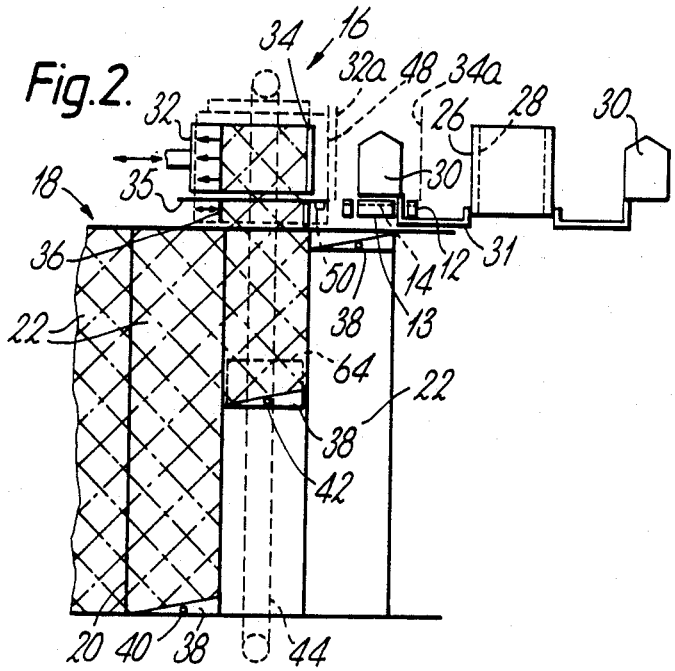
Figure 3:
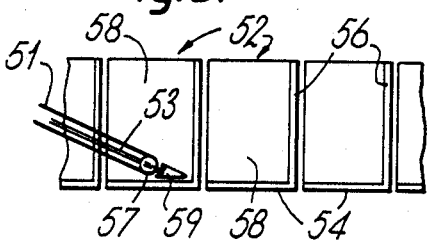
Figure 4:
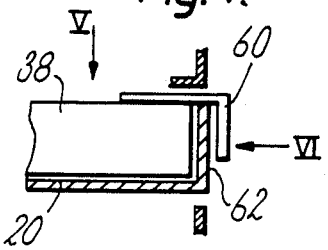
Figure 5:
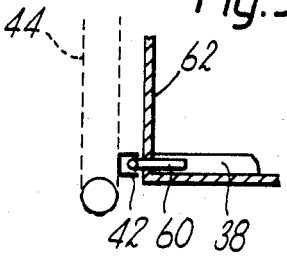
Figure 6:
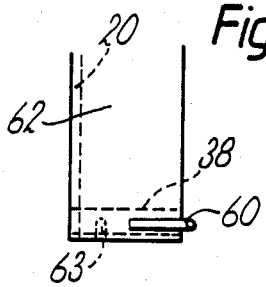
Figure 7:
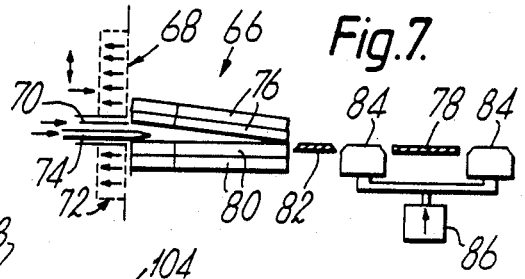
Figure 8:
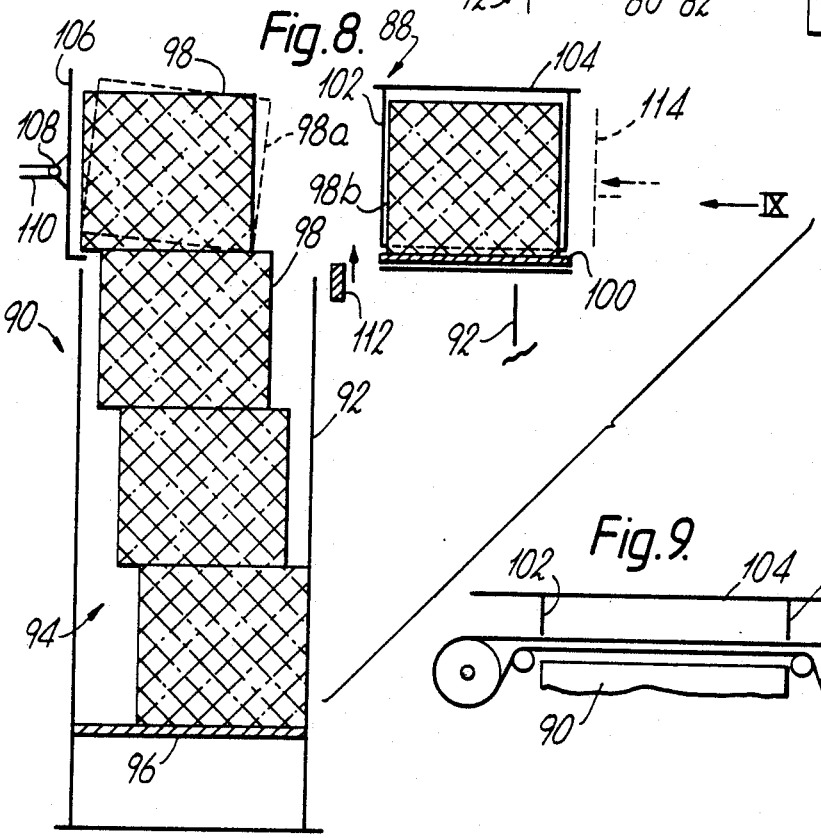
Figure 9:
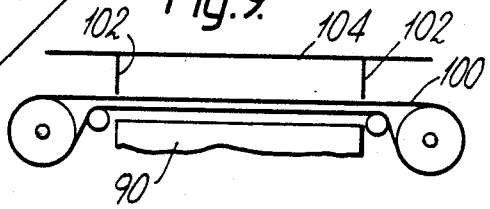
Figure 10:
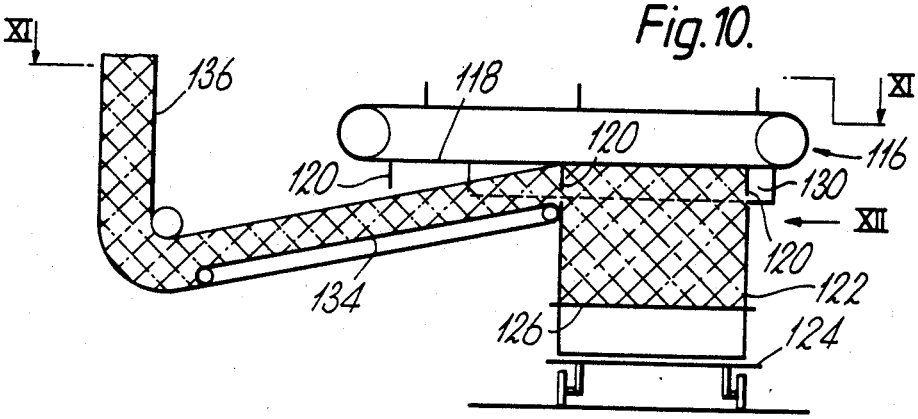
Figure 11:
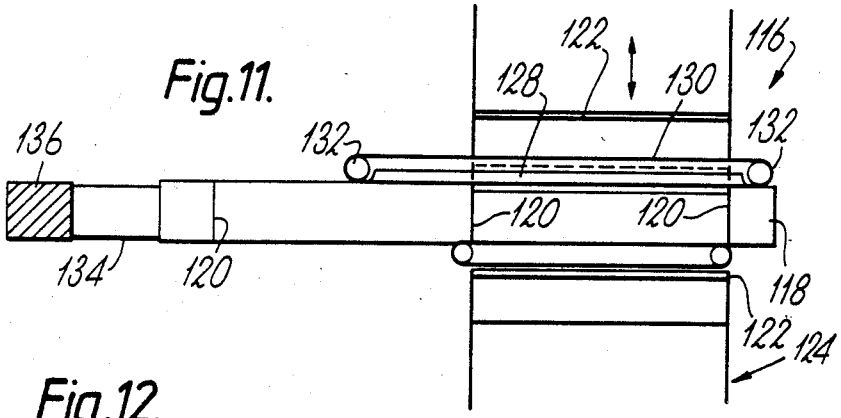
Figure 12:
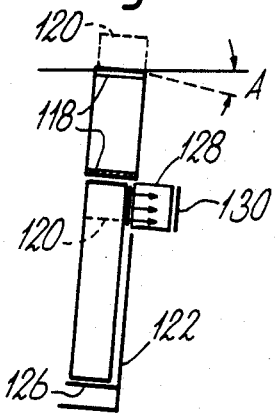

The invention will be further described, by way of example only, with reference to the accompanying diagrammatic drawings, in which:

FIG. 1 is a side view of a conveyor system for cigarettes, including a container station, FIG. 2 is a view of the container station in the direction of arrow II in FIG. 1, FIG. 3 is a side view of part of a conveyor at a modified container station, FIG. 4 is a plan view of a platform lifting arrangement for use with the container station of FIG. 1, FIG. 5 is a view in the direction of arrow V in FIG. 4, FIG. 6 is a view in the direction of arrow VI in FIG. 4, FIG. 7 is a side view of part of another container station, FIG. 8 is a sectional view of part of a further container station, FIG. 9 is a view in the direction of arrow IX in FIG. 8, FIG. 10 is a side view of part of a further conveyor system, including a container station, FIG. 11 is a part-sectional plan view on the line XI—XI in FIG. 10, FIG. 12 is a view generally in the direction of arrow XII in FIG. 10, with some parts omitted for clarity.

Figure 13:
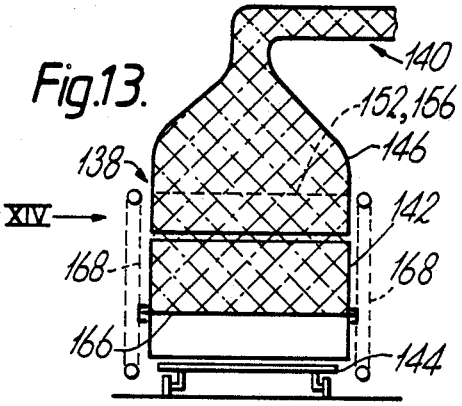
Figure 14:
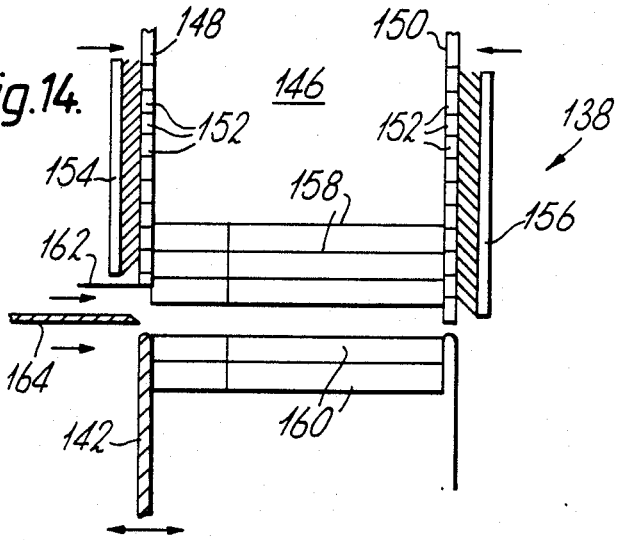
Figure 15:
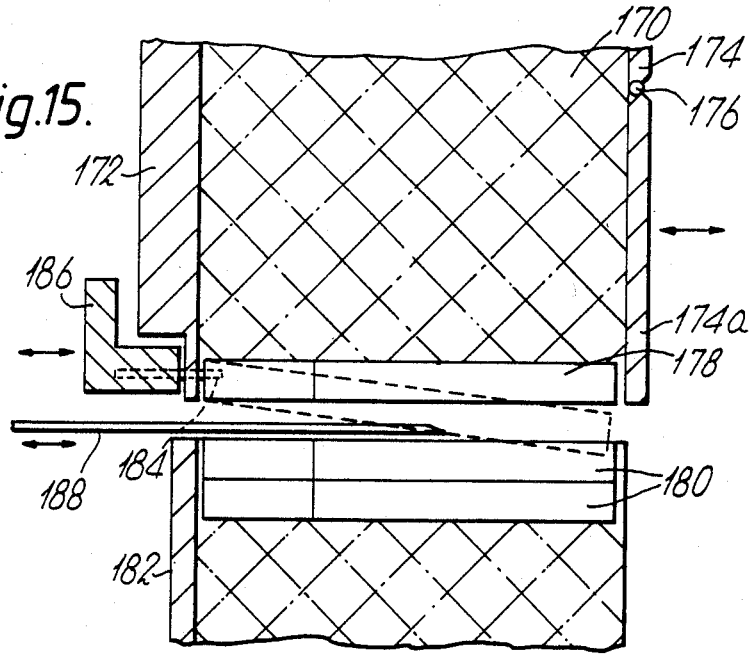
Figure 16:
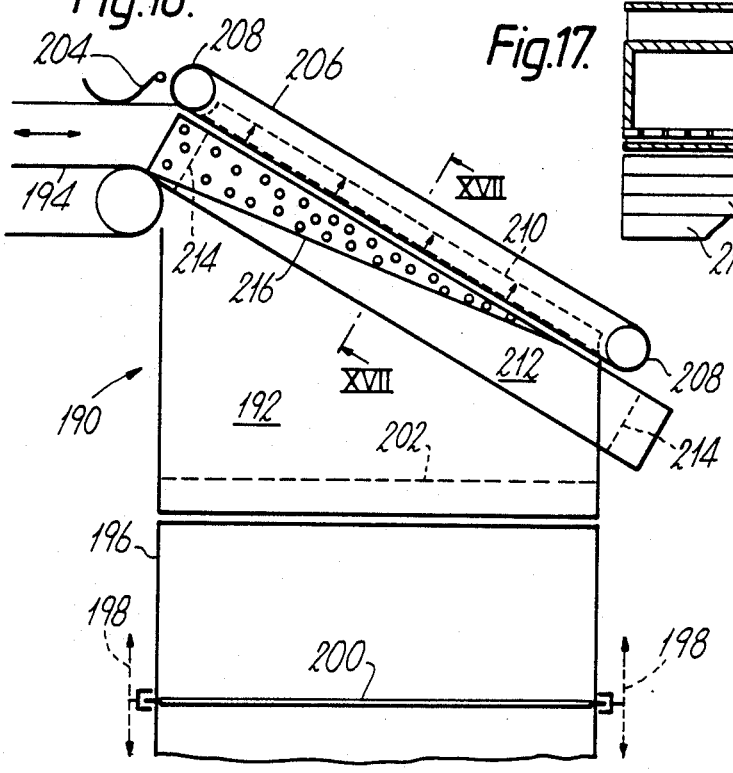
Figure 17:
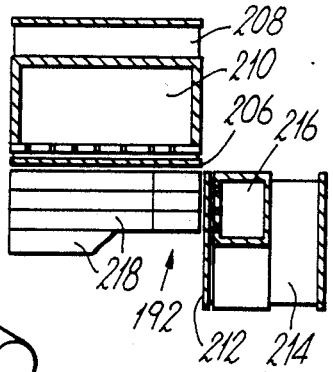
Figure 18:
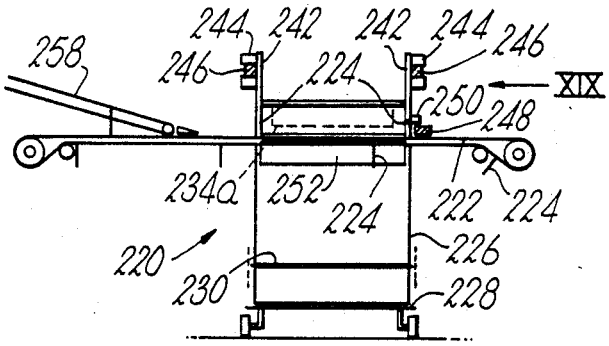
Figure 19:
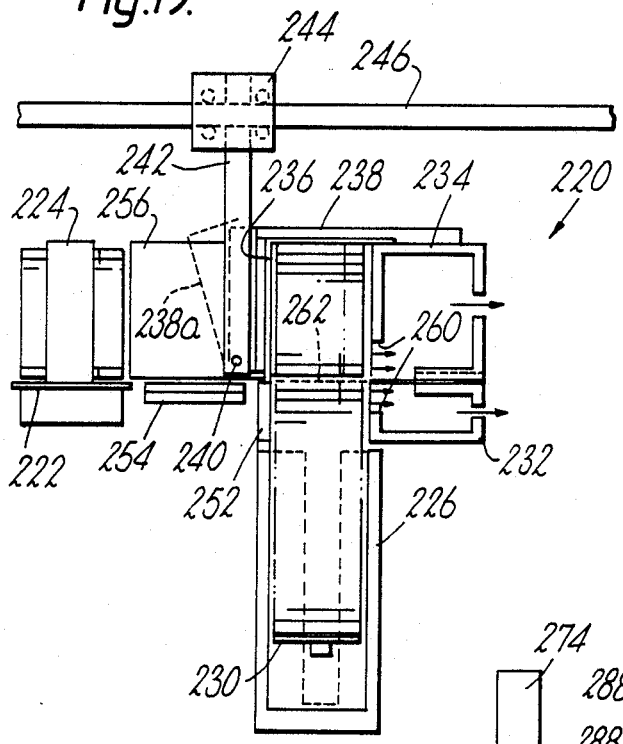
Figure 20:
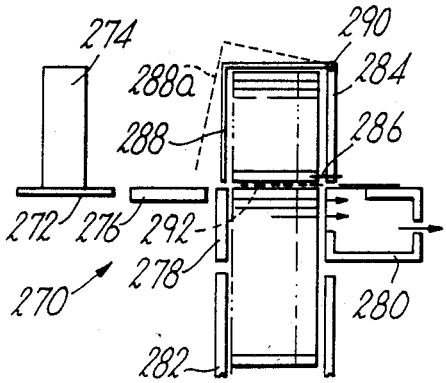

FIG. 13 is a side view of part of a further conveyor system, including a container station, FIG. 14 is a view of the container station in the direction of arrow XIV in FIG. 13, FIG. 15 is a side view of part of a still further container station, FIG. 16 is a side view of part of a further conveyor system, including a container station, FIG. 17 is a sectional view on the line XVII—XVII in FIG. 16, FIG. 18 is a side view of part of yet another container station, FIG. 19 is a view in the direction of arrow XIX in FIG. 18, and FIG. 20 is a part-sectional view of part of a further modified container station.

FIGS. 1 and 2 show a conveyor system for cigarettes, including an endless band conveyor 2 for conveying a multi-layer stream of cigarettes from a cigarette making machine or filter cigarette assembling machine 3 towards the hopper 4 of a cigarette packing machine 5. A junction 6 is arranged between the conveyor 2 and hopper 4, and extending downwardly from this junction is an inclined path defined by band conveyors 8, 10. The conveyor 10 comprises laterally spaced bands and has lower pulleys 12 which are co-axial with an end pulley 13 of a central band conveyor 14 extending horizontally beneath the conveyor 2.

The conveyor 14 forms part of a container station 16 at which cigarettes may be transferred to or from a container comprising a trolley 18. As shown particularly in FIG. 2, the trolley 18 is provided with partitions 20 defining compartments 22. The trolley 18 has wheels 24 to allow it to be moved relative to the station 16 so that transfer of cigarettes may be made to or from successive compartments 22.

At the container station 16 a conveyor 26, which may comprise a timing belt, passes around pulleys 28 having vertical axes and carries outwardly extending spaced partitions 30. The partitions 30 are connected to the main part of the conveyor 26 by U-shaped arms 31 adapted to pass between the conveyors 10 and 14 and beneath the nearest pulley 12. The path of the partitions 30 at the station 16 is immediately above the conveyor 14 and also extends between the spaced bands of conveyor 10. Note that the left hand pulley 28 in FIG. 1 is spaced beyond the conveyor 10 by a distance such that there is no interference as the partitions 30 pass around this pulley.

The partitions 30 define batches of cigarettes on the conveyor 14, the batches being of similar width to that of the compartments 22. As shown particularly in FIG. 2, alongside the conveyor 14 is a transfer device comprising a suction plunger 32 and spaced membrane 34. A row of needles 35 is positioned just beneath the plunger 32 and may be advanced slightly to penetrate the ends of the lowermost cigarettes in a batch held between the plunger 32 and membrane 34. The plunger 32 and membrane 34 (and needles 35) are movable together to transfer a batch of cigarettes between the conveyor 14 and a position in alignment with a short channel 36.

The trolley 18 is moved so that successive compartments 22 are aligned with the channel 36. Each compartment 22 has a captive platform 38 which has extending lugs 40 engageable by a corresponding member 42 on a chain hoist 44 at the station 16. The platforms 38 have inclined upper surfaces to compensate for tip build-up with filter cigarettes.

When a deficit of cigarettes is detected at the junction 6 (e.g. by pivoted sensor 46) or it is otherwise required to deliver cigarettes to the hopper 4 from a trolley 18 then hoist 44 is lifted so that a batch of cigarettes is moved upwards from a compartment 22 into a position between the plunger 32 and membrane 34. Suction is then applied to the plunger 32 and the suction acting on the ends of the cigarettes in the batch draws them towards the plunger with sufficient force to allow the plunger to be lifted slightly to separate the batch from the remaining cigarettes in the compartment 22 and short channel 36. The applied suction passing through and around the cigarettes also draws the membrane 34 against the other ends of the cigarettes and this serves to further increase the suction holding effect on the batch. Insertion of needles 35 a short distance into the (filter) ends of the cigarettes further ensures a clean cut-off, the needles 35 being lifted together with the plunger 32. If necessary, the hoist 44 may be lowered slightly to ensure clearance between the batch held by the plunger 32 and the remaining cigarettes. It should be noted that once above the level of the compartment 22 of a trolley 18 a batch of cigarettes is confined at its ends by side members 48 having a spacing corresponding to the width of a compartment.

A batch of cigarettes is advanced by the plunger 32 across a short bridge member 50 and onto the conveyor 14 between partitions 30 aligned with the side members 48. The conveyors 14, 26, 10 and 8 then all advance at the same speed to move the batch towards the junction 6. As the leading partition 30 advances it is progressively withdrawn from the cigarettes on conveyor 10 as the latter diverges from the path of the conveyor 26. When the trailing partition 30 reaches the former position of the leading partition 30 the conveyors 14, 26, 10 and 8 are stopped and the plunger 32 retracts so that a further batch can be transferred to the conveyor 14 is required.

When there is a surplus of cigarettes at the junction 6 or it is otherwise required to load cigarettes into a trolley 18, and assuming that the plunger 32 and membrane 34 are in the positions **32*a* and 34*a* indicated in FIG. 2, the conveyors 8, 10, 14 and 26 advance at the same speed to the right as shown in FIG. 1. A partition 30 is progressively inserted into the stream on conveyor 10 as the latter descends, and when a batch thus formed is positioned in alignment with a compartment 22 at the station 16 suction is applied to the plunger 32 so that a batch of cigarettes may be withdrawn by movement of the plunger and membrane 34 from the positions 32*a*, 34*a* into the positions shown in full lines in FIG. 2. Subsequently the plunger 32 is lowered slightly (and possibly also the platform 38 in the compartment 22 at the station 16 is lifted slightly) so that the transferred batch is deposited on the platform or on cigarettes already in the compartment above the platform. Subsequently the platform 38 is lowered so that the upper level of the transferred batch is slightly below the top of the channel 36**.

If further loading is required the plunger 32 and membrane 34 are advanced to the positions **32*a*, 34*a* and the conveyors 8, 10, 14 and 26** advanced again to deliver a batch to the plunger.

The sizes of the batches transferred to or from the compartments 22 are such that an integral number of batches is required to fill a compartment. If a loading or unloading sequence is required to continue after a batch has been completely filled or emptied then the trolley 18 is indexed between loading or unloading operations to move a new empty or full compartment 22 to the transfer station 16. Thus, as shown in FIG. 2, the trolley 18 may be indexed to the right to bring full compartments 22 into position for transfer, and indexed to the left to bring empty compartments into the transfer position. Note that in empty compartments 22 it is convenient to arrange that the lifting platform 38 is maintained at or near the top of the compartment; this may be achieved by a spring detent readily overcome by action of the hoist 4.

The compartments 22 extend for the full width of the trolley 18. In an alternative arrangement each compartment may be sub-divided by partitions **22*a* into sub-compartments 22*b*. The width of each subcompartment 22*b* may be chosen in relation to the lengths of the cigarettes it is intended to contain such that a cigarette can be misaligned by a maximum of about 45 degrees, i.e. so that for example the sub-compartment would have a width of about 70 millimeters for cigarettes of 100 milimeter length. It has been found that by providing sub-compartments no wider than this control of twisting of cigarettes, particularly in the upper rows, is more readily achieved. Each sub-compartment 22*b* may be provided with its own lifting platform 38*a*, the platforms in each sub-compartment 22*b* in a single compartment 22 being lifted and lowered together. Similarly, the region above the compartment 22 at the station 16 is sub-divided by partitions 48*a*, having the same spacing as the partitions 22*a*, and the plunger 32 is sub-divided so that it is movable between the partitions 48*a***.

Where the compartment 22 is sub-divided by partitions **22*a* the conveyor 26 may be modified so that it comprises a series of adjacent articulated links 52, as shown in FIG. 3. Each link 52 comprises an L-shaped part, having a cigarette support surface 54 and a partition 56, and a backplate 58. The links 52 are constrained to lie adjacent each other on the run of the modified conveyor at the container station 16 but can become angularly separated as they pass around end pulleys for the conveyor. The spacing of the partitions 56** corresponds to that of the partitions 22*a*. In this modification the conveyor 14 is not required and each of the partitions 16 has one or more vertical slots through which a band or bands of an inclined conveyor 51 similar to the conveyor 10 may extend. A support structure 53 for a lower end pulley 57 for the conveyor 51 may also support a small wedge-shaped deadplate 59 for aiding transfer of cigarettes between the conveyer and the surfaces 54.

A slightly modified arrangement for lifting a platform 38 in a compartment 22 is shown in FIGS. 4, 5 and 6. The member 42 of the hoist chain 44 engages an L-shaped member 60 attached to the platform 38 and extending around side wall 62 extending from the ends of each partition 20. A substantially similar arrangment may be used where the trolley 18 is modified so that it is adapted to hold individual trays which replace the compartments 22. In that case the partition 20 and side wall 62 respectively correspond to the back and side of a tray. As indicated in FIG. 6, the platform 38 may have an aperture in which a peg 63 extending from the bottom of the tray is engaged when the platform is at the bottom of the tray, so that the platform is retained when empty trays are transported.

As shown in FIGS. 1 and 2, the ends of the platforms 38 and 38*a* may be provided with upstanding side plates 64 which lie adjacent the side walls of the trolley 18 or the partitions 22*a*. The plates 64 assist in relieving pressure on cigarettes adjacent the platform 38 or 38*a*, particularly in the case of the platforms 38*a* when the latter are being lifted in the relatively narrow sub-compartments 22*b*.

FIG. 7 shows an alternative arrangement for use at a modified container station 66. A suction plunger 68 and row of needles 70, which are respectively similar to the plunger 32 an needles 35 shown in FIG. 2, are supplemented by a stationary suction chamber 72 and retractable safety plate 74. In order to advance a batch containing cigarettes 76 onto a band conveyor 78 (corresponding to the conveyor 14 in FIGS. 1 and 2) the plunger 68 is advanced to the ends of the cigarettes 76, suction is applied, the needles 70 are inserted a short distance into the ends of the lowermost cigarettes supported by the plunger 68, and the plunger 68 and needles 70 are lifted. Suction applied to cigarettes 80 below the lowermost row of cigarettes 76 (held by needles 70) ensures a clean break between the cigarettes 76 and 80. In addition, the safety plate 74 is advanced once a gap has been created between the cigarettes 76 and 80. The plunger 68, neeldes 70 and safety plate 74 are advanced so that the cigarettes 76 are moved across a bridge 82 onto the conveyor 78. Alternatively, once the plate 74 has been advanced the needles 70 may be retracted from the ends of the cigarettes 76 so that the cigarettes 76 are supported only by suction applied to the plunger 68 and by the safety plate 74 during advancement. The plate 474 is retracted relative to the plunger 68 to deposit the cigarettes 76 on the conveyor 78.

Transfer of cigarettes from the conveyor 78 to the position of the cigarettes 76 in FIG. 7, so that the cigarettes may subsequently be deposited in a compartment containing the cigarettes 80, is basically a reversal of the previously-described arrangement for transferring cigarettes onto the conveyor 78. The suction plunger 68 is moved to a position in which it is in contact with the ends of cigarettes on the conveyor 78. Laterally spaced side members 84 are raised slightly by piston and cylinder 86 so that a batch of cigarettes on the conveyor 78 (and retained at the ends of the batch by partitions 30 or the like) is lifted from conveyor 78. Suction applied to the plunger 68 is then effective to hold cigarettes against the plunger and maintain them there as the plunger is withdrawn, so that the batch is moved over the extended safety plate 74. When the batch has been moved to the left, as shown in FIG. 7, so that it is located above the cigarettes 80 in a compartment of a container at the station 66, the plate 74 is withdrawn and subsequently suction removed from the plunger 68 so that cigarettes are deposited on those cigarettes already in the compartment. Subsequently a platform 38 or the like within the compartment is lowered so that the plunger 68 can be advanced across the top of the compartment to collect a further batch is required.

FIGS. 8 and 9 show an arrangement at a further modified container station 88. A container 90 is provided with partitions 92 defining compartments 94 each of which contains a lifting platform 96. When full, each compartment 94 contains batches of cigarettes 98, the ends of which are staggered by about 6 millimeters, as shown in FIG. 8.

For transfer to a conveyor 100 between partitions 102 extending down from an upper conveyor 104 driven at the same speed as the conveyor 100, an L-shaped plunger 106 pivoted at 108 about a push rod 110 is advanced and lifted so that the uppermost batch 98 is engaged beneath the overlapping ends of the cigarettes in the batch adjacent the plunger 106 and lifted so that the batch is tilted as indicated at 98a. Subsequently the batch is advanced so that the leading ends of the lowermost cigarettes pass over a lifting arm 112 which lifts the leading end of the batch so that it can be moved into position on the conveyor 100, as shown at 98*b*.

For return of batches 98*b* the plunger 106 may comprise a suction head (similar to the plungers 32 and 68). Alternatively, a separate plunger 114 movable from the opposite side of the conveyor 100 may be used. In either case, the distance moved by the plunger 106 or 114 is controlled so that the staggered location of batches in the compartment 94 is maintained. The staggering of the batches aids positive separation of batches for transfer to the conveyor 100, e.g. by allowing the lower support surface of plunger 106 to engage beneath the overlapping portion of successive batches 98. Where the plunger 106 comprises a suction head the suction may be used to assist in separation and transfer of a batch from the container 90 to the conveyor 100 as well as in the reverse direction.

A further modification is shown in FIGS. 10, 11 and 12, in which a container station 116 comprises a conveyor 118 having spaced partitions 120 which transfer batches of cigarettes directly to or from a tray 122 contained in a reversible trolley 124. Each tray 122 contains a lfiting platform 126 movable by a hoist (not shown but, similar to the hoist 44) so that successive batches of cigarettes may be transferred between a tray 122 at the station 116 and the conveyor 118.

During unloading of batches of cigarettes from a tray 122, and assuming that a batch of cigarettes is located between partitions 120 at the station 116, suction is applied to a chamber 128 and applied to the ends of the cigarettes in the batch through a perforated belt 130 which passes around end pulleys 132 and in front of the chamber 128. The applied suction is sufficient to draw the ends of the cigarettes in the batch firmly against the belt 130, so that the batch is retained in position and separated slightly from the remainder of the cigarettes in the trolley 122 when the platform 126 is lowered slightly. Subsequently the conveyors 118 and 130 are driven at the same speed so that the batch is moved onto an inclined conveyor 134. As shown in FIG. 10, the partitions 120 ar progressively withdrawn by divergence of the paths of conveyors 118 and 134, so that a continuous multi-layer stream is delivered to an elevator 136.

Supply of cigarettes to a tray 122 at the station 116 is a reversal of the unloading sequence. Successive partitions 120 are progressively inserted into a stream delivered by the conveyor 134 as the conveyors 118 and 134 converge. Note that the partitions 120 may be flexible or otherwise movable slightly at their ends, to correct for the path length difference between the conveyors 118 and 134 subsequent to initial insertion of a partition 120 into the stream.

It should be noted from FIG. 12 that the trays 122 are held by the trolley 124 in an inclined position. This aids the action of suction through the belt 130, and also helps to retain cigarettes in the trays during movement of the trolley 124. The angle A is preferably about 8 degrees. The conveyor 118 may be locally twisted (by guides, not shown) by the same amount so that it is at 90 degrees to the belt 130.

The movement of the conveyors 118, 134, and 136 is intermittent. A separate reservoir or buffer (e.g. Molins MOLAR) may be provided elsewhere in the system to smooth the flow to a delivery device.

FIGS. 13 and 14 show a further container station 138 at which a multi-layer stream of cigarettes may be received from or delivered to a conveyor system 140. Trays 142 are moved on a trolley 144 beneath a transfer head 146 of the station 138. The transfer head 146 comprises end walls 148, 150, the lower ends of which are formed with flexible plastic fingers 152 which may be displaced inwardly by means of movable brush members 154, 156, so as to grip gently the lowermost cigarettes 158 in the head 146. In this way, separation of the cigarettes 158 from cigarettes 160 in a tray 142 at the station 138 may be achieved. One or more rows of needles 162 and/or a safety plate 164 may be used in addition as in previously-described arrangements. Each tray 142 has a lifting platform 166 movable by a pair of chain hoists 168. Operation is similar to previous arrangements, except that cigarettes may be transferred to or from a container 142 continuously without separation into batches. Successive trays 142 (full or empty) are moved to the station 138 by movement of the trolley 144 in the appropriate direction.

A modified filling head 170 usable at a station similar to the station 138 is shown in FIG. 15. In this arrangement the head 170 has fixed end walls 172, 174, a lower portion **174*a* of the wall 174 being pivoted about a horizontal axis 176. The portion 174*a* is movable inwardly to gently clamp the lowermost cigarettes 180 against the stationary wall 172, so as to hold the cigarettes when it is required to separate them from cigarettes 180 in a container 182 below the head 170. The lowermost surfaces of the wall 172 and of the portion 174*a* may be formed with relatively rough material to help grip the ends of the cigarettes 178. As before, rows of needles 184, mounted on a movable bracket 186, and a safety plate 188, may be used to assist separation of the cigarettes 178 and 180**.

In the arrangements of FIGS. 13, 14 and 15 suction acting on the ends of at least some of the cigarettes may be used to assist separation prior to change of a container 142 or 182. For example a stationary suction chamber similar to the chamber 72 in FIG. 7 may be provided. Alternatively or additionally the lower end of wall 148 (FIG. 14) and 172 (FIG. 15) may be provided with a suction chamber similar to the chamber 68 in FIG. 7.

FIGS. 16 and 17 show another container station 190, at which a transfer head 192 is arranged between a cigarette conveyor 194 and a container 196. A trolley or the like (not shown) may be used to supply successive full or empty containers 196 to a position beneath the head 192 in the same way as the arrangement of FIG. 13. A pair of chain hoists 198 is provided to act on a lifting platform 200 in the container 196. The lower end of the transfer head 192 is provided with a cigarette holding arrangement 202, similar for example to that shown for use with the transfer head 146 or 170 in FIG. 14 or FIG. 15, to retain cigarettes in the head 192 during replacement of containers 196.

A pivoted sensor arm 204 is arranged at the end of conveyor 194 adjacent the transfer head 192. An inclined suction band conveyor 206 passing around pulleys 208 having horizontal axes has a lower run passing over a suction chamber 210 and extends over the top of the transfer head 192. A further suction band conveyor 212 passes around inclined pulleys 214 arranged so that the conveyor 212 is inclined at the same angle (about 30 degrees to the horizontal) as the conveyor 210 but is disposed in a plane at right angles to that of the conveyor 210 and below and to one side of said conveyor. The conveyor 212 passes in front of a triangular suction chamber 216 arranged so that a progressively greater width of the conveyor 212 is influenced by the suction chamber as the conveyor moves acrosss the transfer head 192 in a direction towards the conveyor 194.

The relative speeds of the chain hoist 198 and the conveyor 194 are in inverse proportion to the width of the container 196 and the height of the cigarette stream on conveyor 194. Fine control of the speed of conveyor 194 and/or of the hoist 198 is achieved by operation of the sensor 204, which is arranged to control the speeds so that the height of the stream on conveyor 194 remains substantially constant.

During transfer of cigarettes into a container 196 the conveyors 206 and 212 need not be driven, but if driven preferably move at a similar speed not greater than that of the conveyor 194. If the conveyors 206 and 212 are driven then suction may be applied to the chambers 210 and 216.

During transfer of cigarettes from a container 196 to the conveyor 194 the conveyors 206 and 212 are driven, preferably at the same speed as the conveyor 194, and suction is applied to the chambers 210 and 216. Cigarettes 218 near the top of the transfer head 192 are thus progressively brought under the influence particularly of the suction conveyor 212 so that a steady stream of cigarettes is removed from the upper part of the head 192 thereby allowing the upward movement of the lifting platform 200 without imposing undue pressure on cigarettes in the container 196 or in the filling head 192.

In a modified arrangement the conveyor 206 and suction chamber 210 are omitted.

FIGS. 18 and 19 show a further container station 220 having a conveyor 222 carrying spaced partitions 224 to or from which batches of cigarettes are transferred from a tray 226 carried by a trolley 228. Each tray 226 contains a lifting platform 230.

The station 220 includes a lower stationary suction chamber 232 and an upper movable suction chamber 234. Attached to a forward end of the chamber 234 is a flexible membrane or flap 236. The chamber 234 is carried by side brackets 238 pivotally connected at 240 to a strut 242 which descends from a carriage 244 movable along a track 246. As shown in the FIG. 18, a cam track 248 co-operating with a cam follower 250 controls the pivotal position of the side brackets 238 during movement of the carriage 244. As also shown in FIG. 18, a modified chamber 234*a* may be generally U-shaped so that suction is applied to only those cigarettes adjacent the bottom and sides of a batch.

A side plate 252 is arranged opposite the lower suction chamber 232, and a bridge 254 is arranged between the side plate and the conveyor 222. Above the bridge 254 and extending in line with the sides of a tray 226 at the station 222 and with partitions 224 on the conveyor 222 are end plates 256 which retain the ends of a batch of cigarettes during transfer between the conveyor 222 and a position above the tray. Cigarettes are delivered to or received from the conveyor 222 by an inclined conveyor 258. The conveyor 258 comprises laterally spaced bands so that the partitions 224 may pass between the bands.

Operation of the arrangement of FIGS. 18 and 19 is analogous to previously-described arrangements. During transfer of cigarettes from a tray 226 to the conveyor 222 successive batches of cigarettes are lifted by the platform 230 so that the box formed by the membrane 236 and the suction chamber 234 is substantially filled with cigarettes. Suction is applied to each of the chambers 232 and 234 so that cigarettes respectively below and above the level of conveyor 222 are drawn against and held by the suction port 260 in said chambers. Suction acting from the chamber 234 draws the membrane 236 against the opposite ends of the cigarettes to reinforce the suction effect. Subsequently, the carriage 244 is advanced to the left as viewed in FIG. 19 (by drive means, not shown) and during at least the initial movement the brackets 238 lifted by operation of the camtrack 248 and follower 250 so that they are rotated about pivot axes 240 into positions indicated by the dotted lines 238*a* in FIG. 19. The lifting of the side brackets 238 and the corresponding lifting of the chamber 234 and membrane 236 causes the cigarettes now firmly held between the chamber and membrane to be correspondingly separated from the cigarettes held by the suction effect in chamber 232 and allows the separated batch of cigarettes to be moved towards the conveyor 222 with no risk of damage to the lowermost cigarettes. The shape of the cam track 248 is such that the brackets 238 are lowered to a position in which the cigarettes are substantially horizontal by the time the batch is deposited on the conveyor 222. When the batch has reached this position suction is removed from the chamber 234 and membrane 236 by operation of the conveyor 222 so that the latter moves through a distance equivalent to the spacing between partitions 224. Subsequently the carriage 224 is returned to the position shown in FIG. 19, to receive a further batch of cigarettes from the tray 226 if required.

The suction ports 260 of the chambers 232 and 234 are close together. In order to supplement the suction separation of the cigarettes a retractable divider or safety plate, indicated at 262 in FIG. 19, may be used in addition. The plate 262 could be carried by the chamber 234 so that it aids retention of the cigarettes during transfer to the conveyor 222. A cam follower (not shown) co-operating with the track 248 could be arranged to withdraw the plate 262 just short of the conveyor 222. Alternatively, the plate 262 could be advanced and retracted relative to the chamber 234 by pneumatic means.

Filling of a tray 226 is basically achieved by a reversal of the operations described for unloading. However, suction need not be applied to the chamber 232 during filling.

FIG. 20 shows a modified container station 270 which is basically similar to the station 220. The station 270 includes a conveyor 272 with spaced dividers 274, bridge 276, side plate 278 and stationary suction chamber 280. All these parts are similar to the similar parts in the station 220 and are used in an analogous way to transfer cigarettes to or from a tray 282.

Instead of an upper suction chamber 234 the station 270 has a back plate 284 which carries a row of retractable pins 286. A flap 288 is pivoted to the back plate 284 at 290.

Operation of the station 270 is similar to that of the station 220. During transfer from the tray 282 to the conveyor 272 separation of the cigarettes between the back plate 284 and the membrane 288 is achieved by insertion of the needles 286 and simultaneous application of suction to the chamber 280. Subsequently the back plate 284 may be lifted and advanced by a mechanism similar to that associated with the carriage 244. A retractable safety plate 292 may be inserted after initial lifting of the back plate 284 to retain the cigarettes and subsequently the needles 286 may be withdrawn.

In any of the arrangements described herein a tray or other container provided with substantially horizontal partitions to define spaces for receiving single batches of cigarettes may be used. Trays of this type are disclosed in U.S. Pat. No. 3,967,740. Where an arrangement is used with containers having such partitions suction may not be necessary for separation of batches but is still useful as an aid to transfer, particularly for moving batches in the same direction as the applied suction. Retention of suction transfer and separation means is also preferred so that it is still possible to use the arrangement with containers not having horizontal partitions.

We claim:

1. A conveyor system for rod-like articles comprising a rod-like article delivery device, a rod-like article receiving device, conveyor means linking said article delivery and article receiving devices for conveying articles in multi-layer formation, a reversible resevoir for holding rod-like articles in stack formation and being connectable to said conveyor means, and means for transferring rod-like articles in stack formation between said reservoir and said conveyor means, said transferring means including suction means for effecting separation between batches of rod-like articles to allow relative movement of a separated batch and the stack of rod-like articles in a direction transverse to a line of separation between the batch and the stack, said suction means including means for applying suction to the end faces only of rod-like articles and means for moving said suction applying means in a direction transverse to the lengths of the rod-like articles to move said rod-like articles as a batch in said transverse direction.

2. A conveyor system as claimed in claim 1, wherein the means for applying suction comprises means for applying suction on at least one side of a line along which it is requried to separate batches of articles in multi-layer stack formation.

3. A conveyor system as claimed in claim 1, wherein the means for applying suction comprises movable suction conveyor.

4. A conveyor system as claimed in claim 3, wherein the movable suction conveyor is arranged to move articles in a direction transverse to their lengths.

5. A conveyor system as claimed in claim 3, wherein the movable suction conveyor is arranged to move articles in a direction parallel to their lengths.

6. A conveyor system as claimed in claim 1, wherein the transferring means includes means for moving successive batches of articles into the vicinity of said suction means.

7. A conveyor system as claimed in claim 6, wherein the reservoir comprises at least one container capable of holding the equivalent of several batches of articles, said moving means comprising a member movable in a container.

8. A conveyor system as claimed in claim 1, wherein the reservoir comprises a reversible buffer store and the transferring means is reversible.

9. A conveyor system as claimed in claim 8, wherein articles are moved in a generally upward direction for transfer from said reservoir to said conveyor means and correspondingly in a generally downward direction for transfer from said conveyor means to said reservoir, said suction means being operable for separation when articles are being transferred from the reservoir to the conveyor means.

10. A conveyor system as claimed in claim 1, wherein said suction means comprises endless band means for transferring a stream of articles between the reservoir and the conveyor means, said endless band means for including means engaging and applying suction to the end faces of articles in said stream.

11. A conveyor system as claimed in claim 10, wherein said reservoir extends upwardly and said endless band means is arranged to act on the uppermost articles in the reservoir.

12. A conveyor system as claimed in claim 11, wherein the endless band means includes means engaging the sides of articles in said stream.

13. A conveyor system as claimed in claim 11, wherein said endless band means has a path which is inclined to the horizontal.

14. A conveyor system for rod-like articles comprising an article delivery device, an article receiving device, conveyor means linking said article delivery and article receiving devices, and a reversible reservoir for articles connectable to said conveyor means, including means for transferring articles between the reservoir and the conveyor means, the transferring means including suction means for effecting separation between articles to allow relative movement of said articles by applying suction to the ends of the articles, wherein the suction means includes a membrane arranged to seal the ends of the articles opposite the ends to which suction is applied by said means for applying suction, said suction means including a suction conveyor and said membrane being connected for movement with said suction conveyor.

15. A conveyor system for rod-like articles, comprising an article delivery device, an articles receiving device, conveyor means linking said devices, and a reversible reservoir for articles connectable to said conveyor means, said reservoir including at least one container in which articles are stored in multi-layer stack formation, and means for separating said articles into batches for transfer from said container to said conveyor means, said separating means including suction means acting on the end faces of at least the lowermost articles in a batch and means for effecting movement of said suction means to cause separation of said articles into batches in a direction transverse to the lengths of said articles, and said suction means including a first suction member operable on the lowermost articles in a batch and a further suction member operable on articles in the container adjacent said lowermost articles, said first and further suction members each acting on the end faces of the articles and being relatively movable to separate and move apart multi-layer formations of articles.

16. A conveyor system as claimed in claim 15, wherein said conveyor means includes a subsidiary conveyor provided with spaced partitions for receiving a batch of articles, and said separating means includes means for moving a batch of articles in a direction generally parallel to the lengths of said articles to transfer a batch of articles onto said subsidiary conveyor.

17. A conveyor system as claimed in claim 16, including means for moving said partitions relative to a path for articles on said subsidiary conveyor, whereby a stream may be divided into batches or batches reformed into a stream on said path.

18. A conveyor system as claimed in claim 15, wherein the separating means includes means operable on both ends of the lowermost articles in a batch of articles.

19. A conveyor system as claimed in claim 15, wherein the separating means includes means for displacing a batch of articles in a direction away from articles in the container not later than movement in any other direction.

20. A conveyor system as claimed in claim 15, wherein said separating means includes suction means acting on the ends of the articles and said reservoir is arranged such that said articles are inclined so that gravity aids the effect of said suction to retain said articles.

21. A conveyor system for rod-like articles, comprisinig first conveyor means for conveying rod-like articles in a multi-layer stack formation having a first height, second conveyor means for conveying rod-like articles in a multilayer stack formation having a second height, said second height being at least equal to said first height, and means for transferring rod-like articles between said first and second conveyor means, said transferring means including first means for separating rod-like articles into batches of said first height on said first conveyor means, and second means for separating rod-like articles into batches of said first height on said second conveyor means, and means for moving said first and second means on paths having a common portion to effect transfer of batches between said first and second conveyor means, said second means including endless band suction means having a conveying surface extending in a plane substantially transverse to the lengths of the rod-like articles.

22. A conveyor system as claimed in claim 21, wherein said first conveyor means comprises an endless band conveyor and said second conveyor means comprises a movable container.

23. A conveyor system as claimed in claim 22, wherein said second height is an integral multiple of said first height.

* * * * *